US008893441B1

(12) United States Patent
Hess, III et al.

(10) Patent No.: US 8,893,441 B1
(45) Date of Patent: Nov. 25, 2014

(54) CONTINUOUS LOAD PATH CONSTRUCTION BEAM

(71) Applicants: John Hess, III, Pascagoula, MS (US); John Hess, IV, Mobile, AL (US)

(72) Inventors: John Hess, III, Pascagoula, MS (US); John Hess, IV, Mobile, AL (US)

( * ) Notice: Subject to any disclaimer, the term of this patent is extended or adjusted under 35 U.S.C. 154(b) by 0 days.

(21) Appl. No.: 14/104,696

(22) Filed: Dec. 12, 2013

Related U.S. Application Data

(63) Continuation-in-part of application No. 13/919,215, filed on Jun. 17, 2013.

(51) Int. Cl.

| | |
|---|---|
| ***E04B 7/04*** | (2006.01) |
| ***E04D 13/00*** | (2006.01) |
| ***E04B 1/38*** | (2006.01) |
| ***E04H 9/14*** | (2006.01) |

(52) U.S. Cl.
CPC *E04H 9/14* (2013.01); *E04D 13/00* (2013.01); *E04B 1/38* (2013.01)
USPC ..... 52/92.2; 52/93.2; 52/167.1; 52/831; 52/745.2

(58) Field of Classification Search
CPC . E04B 1/2608; E04B 1/24; E04B 2001/2415; E04B 2001/2684; E04B 2001/2439; E04B 7/045; E04B 2001/2463; E04B 2001/249; E04H 9/14; E04C 2003/026
USPC ..... 52/92.1, 92.2, 93.1, 93.2, 167.1, 698, 52/702, 712, 713, 745.2, 831, DIG. 11
See application file for complete search history.

(56) References Cited

U.S. PATENT DOCUMENTS

| | | | | |
|---|---|---|---|---|
| 5,303,520 | A * | 4/1994 | Gozdziak | 52/92.2 |
| 5,640,822 | A * | 6/1997 | Haswell | 52/712 |
| 5,870,861 | A * | 2/1999 | Gnaedinger | 52/93.1 |
| 7,716,877 | B2 * | 5/2010 | Gilstrap et al. | 52/92.2 |
| 2004/0118053 | A1 * | 6/2004 | Huppert | 52/23 |
| 2006/0059794 | A1 * | 3/2006 | Gilstrap et al. | 52/90.1 |
| 2010/0236158 | A1 * | 9/2010 | Carbonaro | 52/92.1 |
| 2011/0072732 | A1 * | 3/2011 | Schilling | 52/23 |

* cited by examiner

*Primary Examiner* — Brian Glessner
*Assistant Examiner* — Brian D Mattei
(74) *Attorney, Agent, or Firm* — Thompson Coburn LLP

(57) ABSTRACT

A continuous load beam provides a continuous load path from a roof truss of a structure to a footing of a structure. The beam has a roof truss mounting portion and an elongate spanning portion. The elongate spanning portion has a connector and a footing attachment opposite the connector. The footing attachment is configured to be connected to a structural member of the structure adjacent to the footing of the structure. The roof truss mounting portion is configured to be connected to a structural member of the roof truss of the structure. The roof truss mounting portion has a bifurcated end with spaced apart yoke arms and a truss cap pivotally connected to each of the yoke arms. The truss cap is configured to engage at least a portion of the roof truss structural member. The roof truss support portion has a connector. The roof truss mounting portion connector is configured to be releasably connected to the elongate spanning portion connector.

20 Claims, 4 Drawing Sheets

CONTINUOUS LOAD PATH CONSTRUCTION BEAM

RELATED APPLICATION DATA

This application is a continuation in part of application Ser. No. 13/919,215, filed Jun. 17, 2013, currently pending, the disclosure of which is incorporated by reference herein.

BACKGROUND AND SUMMARY

This disclosure is related to a construction beam which is used to provide a continuous load path from a roof truss of a structure to a footing of the structure to limit damage to the structure, for instance, during high winds, preventing the roof from blowing off the structure.

DETAILED DESCRIPTION

Figure 1:
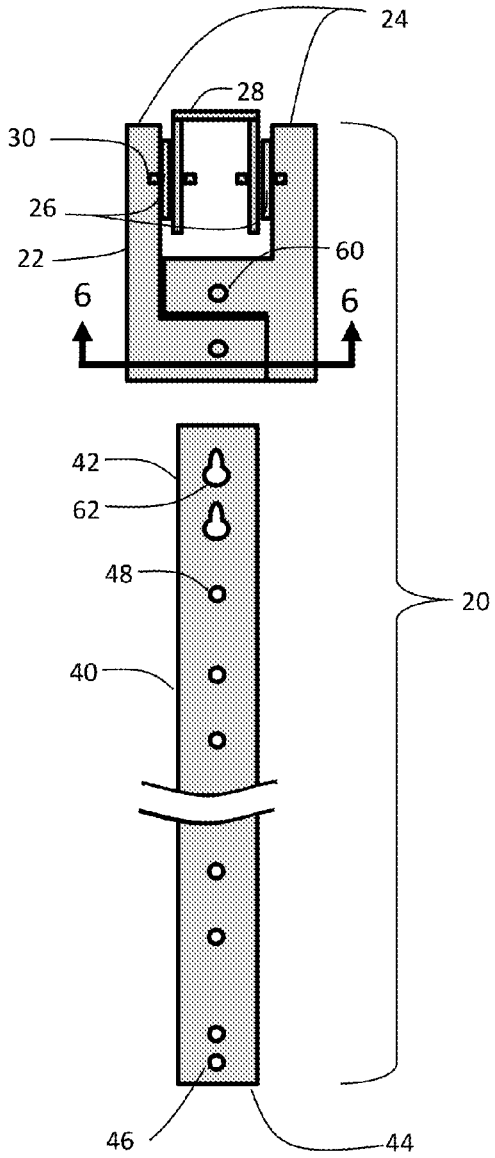
FIG. 1 illustrates an exploded, front view of a continuous load path construction beam.
Figure 2:
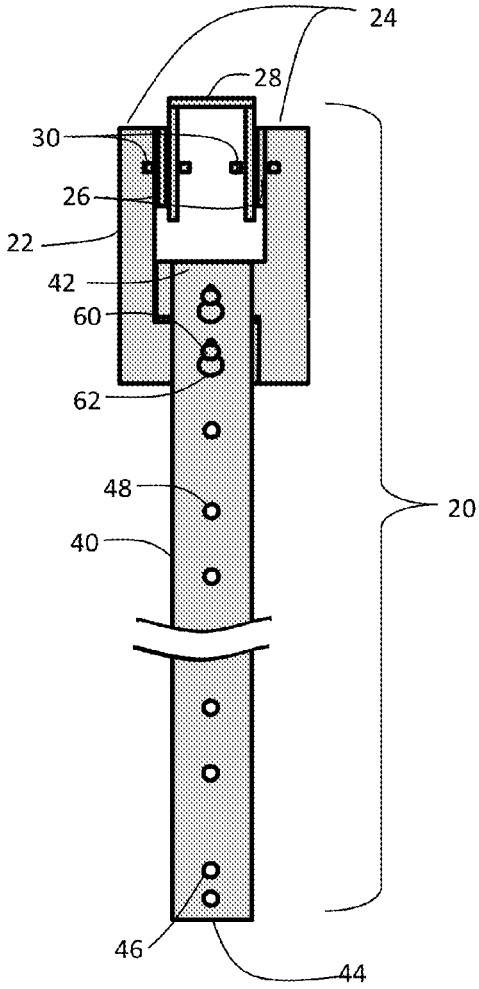
FIG. 2 illustrates an assembled, front view of the beam of FIG. 1.
Figure 3:
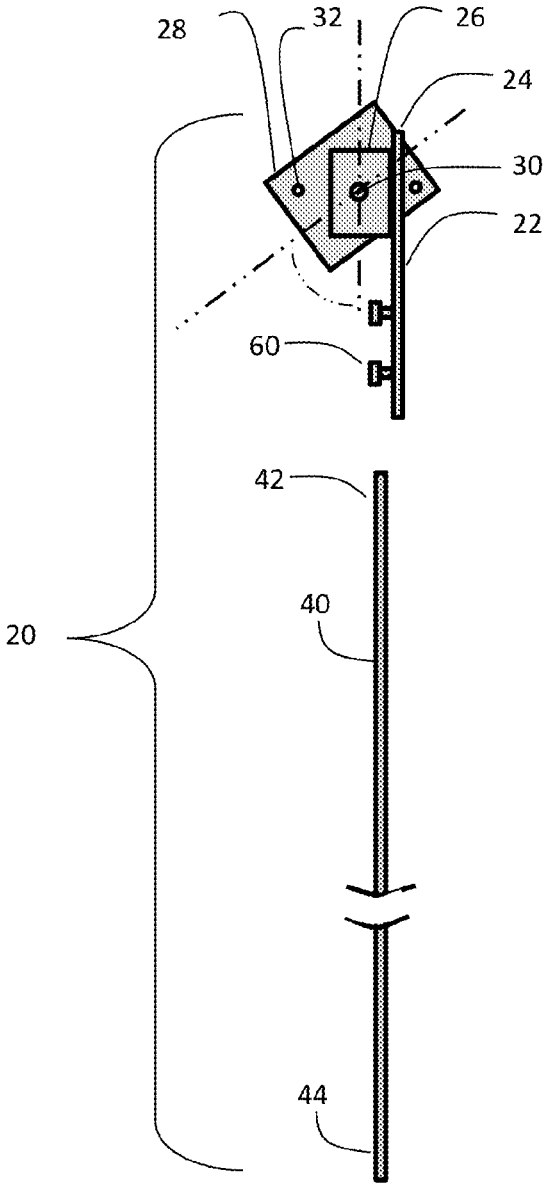
FIG. 3 illustrates a right side view of the beam of FIG. 1 (the left side view being a mirror image thereof), differing from FIG. 1 in that a truss cap is pivoted to an offset angle.
Figure 4:
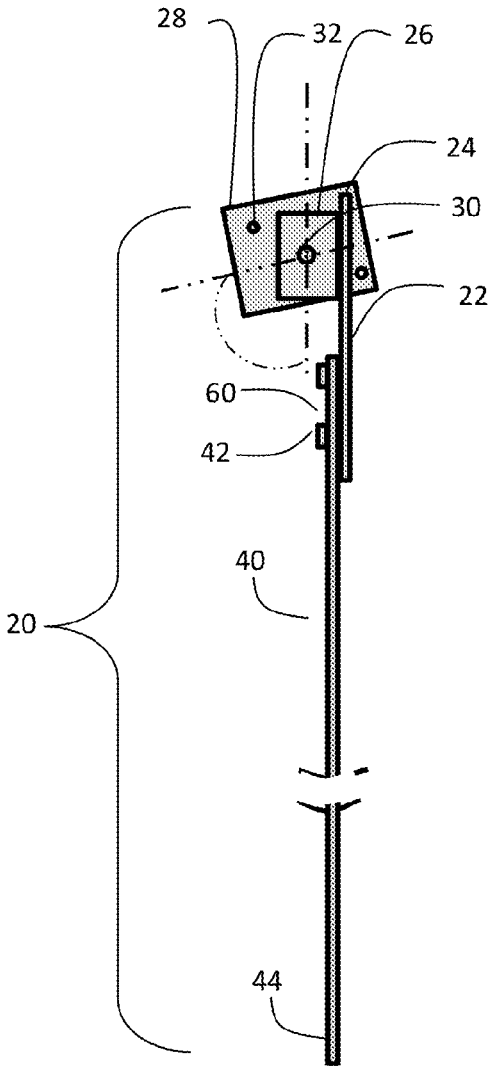
FIG. 4 illustrates a right side view of the beam of FIG. 2 (the left side view being a mirror image thereof) differing from FIG. 2 in that a truss cap is pivoted to an offset angle.
Figure 5:
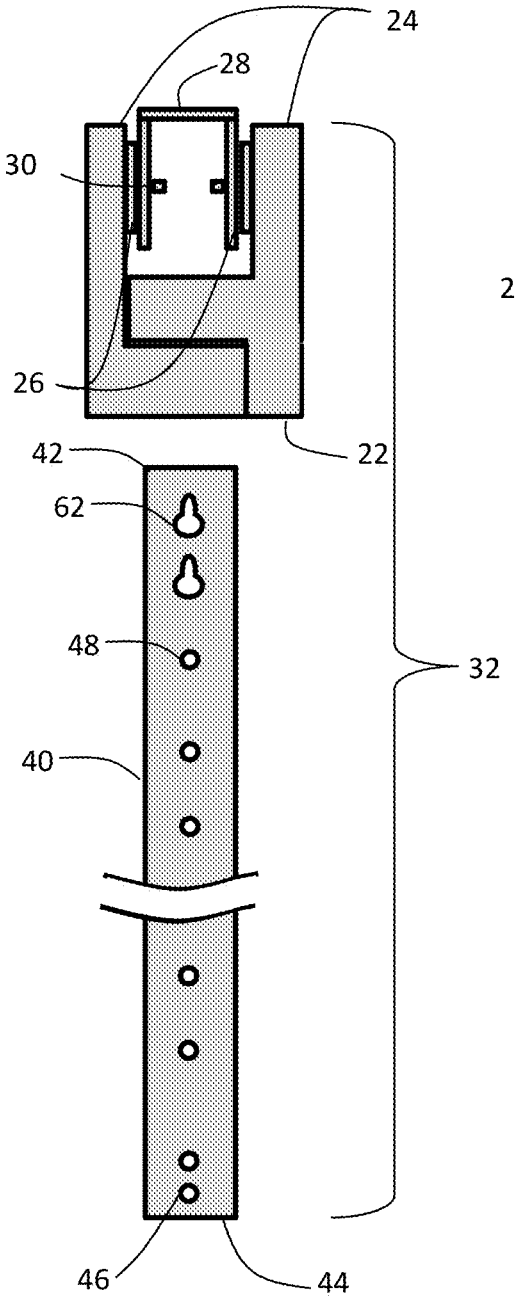
FIG. 5 illustrates a rear view of the beam of FIG. 1.
Figure 6:
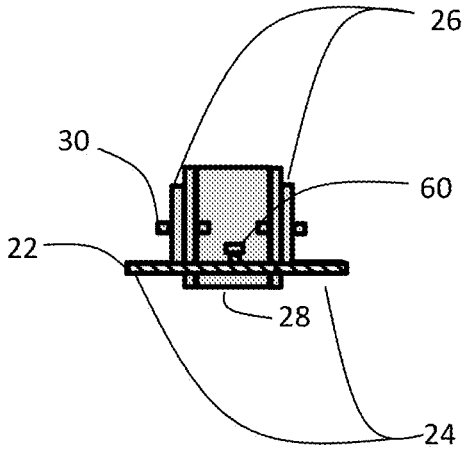
FIG. 6 illustrates a cross sectional view of a roof truss mounting portion taken along lines 6-6 of FIG. 1.

A construction beam provides a continuous load path from the roof truss to the foundation. Several embodiments of such a construction beam were disclosed in the parent application Ser. No. 13/919,215, filed Jun. 17, 2013, currently pending, the disclosure of which is incorporated by reference herein. The inventors have continued their development and disclose herein a further refinement of the construction beam.

The construction beam 20 has a roof truss mounting portion 22 with a bifurcated end 24 with yoke arms 26 which are configured to primarily fit around the sides of a beam comprising the roof truss of a structure, although it may fit around other structural members of a structure adjacent to the truss. The bifurcated end 24 comprises a "U"-shape formed by two forks with spaced-apart yoke arms 26 that are slightly larger than the distance that spans the typical width of a structural member used in residential construction, for instance, 1½". The bifurcated end 24 has a truss cap 28 with a pivot connection 30 to each yoke arm 26. The truss cap 28 is configured to fit around the top and sides of the roof truss structural member. The truss cap may be a single piece, for instance, a generally "U"-shaped channel as shown, or the truss cap may comprise a plurality of pieces, for instance, two "L"-shape cross section members each pivotally connected to a respective yoke arm. The truss cap 28 may have a plurality of holes 32 to allow the roof truss mounting portion to be secured to the roof truss structural member with a mechanical fastener (i.e., nail, screw) directed through the hole into the structural member.

The construction beam 20 has an elongate spanning portion 40. The elongate spanning portion 40 has a connector 42 and an attachment end 44 opposite the connector 42. The attachment end 44 preferably secures the construction beam to the footing, brick ledge, or other structural members of the structure adjacent to the footing. The attachment end 44 may have a plurality of mounting holes 46 arranged vertically in rows to enable the attachment portion to be mounted to a brick ledge or footing of a structure. The spanning portion 40 extends between the roof truss mounting portion 22 and the attachment end 44 and provides a continuous load path from the roof truss to the footing. Preferably, the elongate spanning portion has a plurality of holes 48 to allow it to be secured the vertical structural members of the structure, for instance, a stud or wall sheathing. The elongate spanning portion may be formed as a band of 16 gage or 20 gage steel with a width of 1½ inches.

The construction beam 20 may be formed as a two-piece assembly, as shown, with one piece having the roof truss mounting portion 22 and the other piece having the elongate spanning portion 40. The elongate spanning portion may have a monolithic construction, and the yoke arms and bifurcated end of the roof truss mounting portion may have a monolithic construction. The two-piece assembly facilitates installation of the construction beam and allows the beam to have an adjustable length to accommodate variations in the distance between truss and the footing mounting locations. The length is preferably adjustable between 8 feet and 10 feet. The drawing figures show the elongate spanning portion 40 with conventional drawing sectional breaks to show that the beam may be any length and adjustable to any length. The plurality of mounting holes 46,48 may be arranged in rows on the elongate spanning portion and on the attachment end to allow for any variation in distance and alignment between the roof truss beam and brick ledge during installation. The attachment end may also be embedded in concrete to secure the beam to the footing or cut as desired to fit an installation. The forks of the bifurcated end may also have mounting holes (not shown). The roof truss mounting portion may have a split opposite the truss cap to facilitate installation over a roof truss structural member.

The truss mounting portion 22 and elongate spanning portion 40 each have cooperating connectors 60,62 to allow the beam to extend in a continuous fashion from the roof truss to the footing. The connector may comprise an interlocking pin 60 and slot 62. For instance, as shown in the drawings, roof truss mounting portion 22 may have vertically arranged pins 60 with an enlarged head, and the elongate spanning portion connector 62 may have matching vertically arranged slots with an large diameter portion configured to receive the enlarged head of the pin and a small diameter portion to capture the head of the pin and secure the roof truss mounting portion to the elongate spanning portion. Alternatively, the pin and slot configuration may be reversed and/or may have another spatial configuration. Alternatively, the roof truss mounting portion may be connected to the elongate spanning portion with mechanical fasteners.

Figure 7:
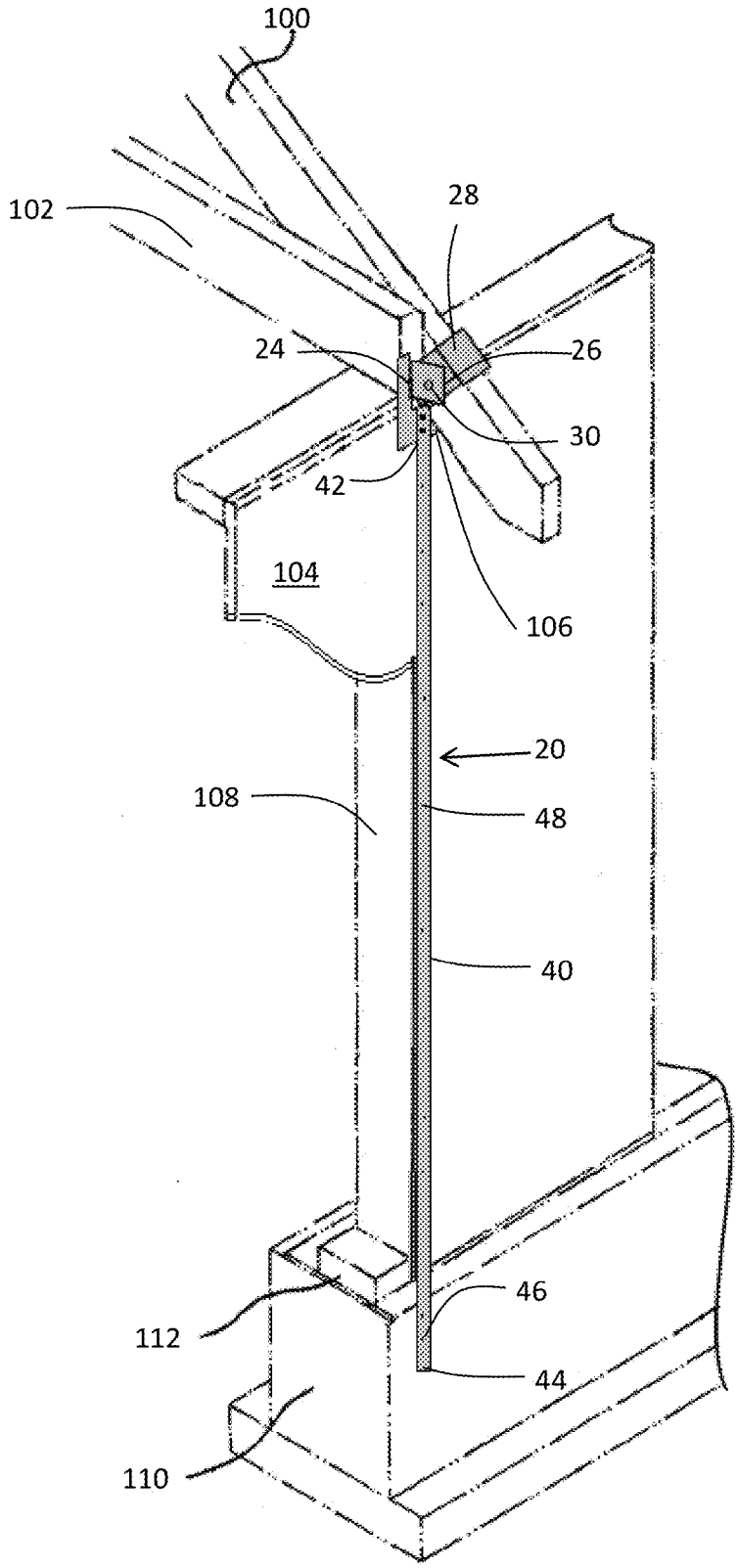
FIG. 7 illustrates a perspective partial view of a structure with the beam of FIG. 1 installed thereon.

As shown in FIG. 7, the beam 20 may be installed by placing the truss cap 28 over the top of the roof truss structural member comprising a top beam 100 and the forks of the bifurcated end 24 on either side of the roof truss structural member. The roof truss mounting portion 22 may be secured in placed with mechanical fasteners directed through the mounting holes 30 on the truss cap 28 and/or roof truss mounting portion. Depending upon the construction, the forks of the bifurcated end may be placed around the truss top beam 100 or other framing or structural members 102 of the structure adjacent to the roof truss. Pivoting the truss cap 28 relative to the yoke arms 26 and bifurcated end 24 allows for adjustment for roof pitch. Thus, the truss cap 28 may be pivoted relative the yoke arms 26 of the bifurcated end 24 so the bifurcated end may be positioned flat against the outer wall 104 under a roof eave 106. The elongate spanning portion may be placed adjacent to wall sheathing of the outer wall 104, and a vertical stud 108 of the structure. In FIG. 9, the outer wall sheathing 104 has been shown in cut-away section to illustrate the location where the beam 20 may be positioned relative to the wall sheathing and the stud 108. The connectors 60,62 of the roof truss mounting portion and the elongate spanning portion may be engaged and the attachment end 44 may be mounted to the brick ledge or footing 110 of the structure, and secured in placed with mechanical fasteners directed through the mounting holes 46. Depending upon the construction, the attachment end 44 may be secured to the footing 110 or other framing or structural members 112 of the structure adjacent to the footing. The spanning portion 40 may be secured to the stud 108 thought the wall sheathing 104 with mechanical fasteners directed through the mounting holes 48. Depending upon the construction, the spanning portion may also be secured to the wall sheathing only.

The construction beam may be used as a retrofitting modification to an existing structure or in new construction in the same way. Backing and/or insulating materials may be arranged over the elongate spanning portion. The flat arrangement of the bifurcated end allows soffit materials to be fitted against the wall of the structure under the roof eave without interference with the yoke arms hidden within the soffit under the roof eave. The construction beam may be hidden from sight after installation of any facade. Construction beams may be provided intermittently spaced along the outer walls of the structure of thereby maximizing the continuous load path from the roof truss to the footing.

Conventional tie downs are often used to secure roof truss members to wall framing and wall framing to a foundation of a structure. While these tie downs and wall framing structural members are used to provide a continuous load path from the roof truss to the foundation, numerous mechanical fasteners are often required at their connection points. The numerous fasteners used at the connection points of the roof truss to the wall framing and wall framing to the foundation may create stress concentration points and potential weaknesses in the load path. The construction beam disclosed herein provides an independent load distribution path that is not dependent upon the structure. The connection points of the construction beam to the structural members of the structure (i.e., roof truss beam, brick ledge) do not require numerous fasteners as the construction beam provides an independent path for force transmission that is not dependent upon the structure. Eliminating the numerous fasteners otherwise used at the connection points of the roof truss to the wall framing and the wall framing to the foundation of the structure reduces stress concentration points and potential weaknesses in the load path.

The construction beam disclosed herein allows builders of new construction to completely frame the structure and thereafter install the continuous load path construction beam. Conventional tie downs are often installed during the framing process after each roof truss and wall framing member is set in place. Also, conventional tie downs are often installed on interior surfaces of the structure. Interior finishing work must wait until the conventional tie downs are completely installed. This could slow construction. Because the construction beam disclosed herein is installed on the outside of the structure, it may be installed without regard to interior finishing work. Thus, using the construction beam herein allows more flexibility in new construction, and use in retrofit construction where often conventional tie downs cannot be used because of the need to locate the convention tie down on an interior surface of the structure.

The embodiments were chosen and described in order to best explain the principles of the invention and its practical application to thereby enable others skilled in the art to best utilize the invention in various embodiments and with various modifications as are suited to the particular use contemplated. As various modifications could be made in the constructions and methods herein described and illustrated without departing from the scope of the invention, it is intended that all matter contained in the foregoing description or shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

What is claimed is:

1. A continuous load beam for a structure, the beam being adapted to provide a continuous load path from a roof truss of a structure to a footing of the structure, the beam having a roof truss mounting portion and an elongate spanning portion, the elongate spanning portion having a connector and a footing attachment opposite the connector, the footing attachment being configured to be connected to a structural member of the structure adjacent to the footing of the structure, the roof truss mounting portion being configured to be connected to a structural member of the roof truss of the structure, the roof truss mounting portion having a bifurcated end with spaced apart yoke arms and a truss cap pivotally connected to each of the yoke arms, the truss cap being configured to engage at least a portion of the roof truss structural member, the roof truss support portion having a connector, the roof truss mounting portion connector being configured to be releasably connected to the elongate spanning portion connector.

2. The beam of claim 1, wherein the beam is configured to be installed on an outside wall of the structure.

3. The beam of claim 1, wherein the truss cap comprises a generally u-shaped channel.

4. The beam of claim 3, wherein the generally u-shaped channel is dimensioned in accordance with the roof truss structural member.

5. The beam of claim 1, wherein the bifurcated end and yoke arms are monolithically formed.

6. The beam of claim 1, wherein the elongate spanning portion is a generally flat band.

7. The beam of claim 1, wherein the roof truss mounting portion is configured to be connected adjacent to a roof eave.

8. A method comprising:

accessing a beam having a roof truss mounting portion and an elongate spanning portion, the elongate spanning portion having a connector and an attachment end opposite the connector, wherein the roof truss mounting portion has a bifurcated end with spaced apart yoke arms and a truss cap pivotally connected to each of the yoke arms, wherein the roof truss mounting portion has a connector, wherein the roof truss mounting portion connector is configured to be releasably connected to the elongate spanning portion connector;

arranging the beam in a manner such that the elongate spanning portion is adjacent to an outside surface of the structure;

securing the roof truss mounting portion to a first structural member of the structure;

connecting the roof truss mounting portion connector with the elongate spanning portion connector;

securing the elongate spanning portion attachment end to a second structural member of the structure vertically opposite the first structural member; and securing the spanning portion to a vertically extending structural member of the structure, the vertically extending structural member being disposed between the first and the second structural members.

9. The method of claim 8, wherein the step of securing the roof truss mounting portion to a first structural member of the structure comprises securing the truss cap to a roof truss structural member of the structure.

10. The method of claim 9, wherein step of securing includes positioning the truss cap over a top and sides of the roof truss structural member.

11. The method of claim 8, wherein the bifurcated end and yoke arms are monolithically formed.

12. The method of claim 8, wherein the step of securing the roof truss mounting portion to a first structural member of the structure comprises securing the roof truss mounting portion adjacent to a roof eave.

13. The method of claim 8, wherein the vertically extending structural member comprises wall sheathing.

14. The method of claim 8, wherein the elongate spanning portion is a generally flat band.

15. The method of claim 8, wherein the step of securing the roof truss mounting portion to a first structural member of the structure includes pivoting the truss cap relative to its respective yoke arm in accordance with a relative position of the first structural member.

16. The method claim 8, wherein the step of securing the elongate spanning portion attachment end to a second structural member of the structure includes securing the attachment end to a structural member adjacent to a footing of the structure.

17. A continuous load beam for a structure, the beam being adapted to provide a continuous load path from a roof truss of a structure to a footing of the structure, the beam having a roof truss mounting portion and an elongate spanning portion, the elongate spanning portion having a connector and a footing attachment opposite the connector, the footing attachment being configured to be connected to a structural member of the structure adjacent to the footing of the structure, the roof truss mounting portion being configured to be connected to a structural member of the roof truss of the structure, the roof truss mounting portion having a bifurcated end with spaced apart yoke arms and a truss cap pivotally connected to each of the yoke arms, the truss cap being configured to engage at least a portion of the roof truss structural member, the roof truss support portion having a connector, the roof truss mounting portion connector being configured to be releasably connected to the elongate spanning portion connector; and wherein the roof truss mounting portion connector and elongate spanning portion connector comprise an interlocking pin and slot.

18. The beam of claim 17 wherein the interlocking pin and slot are aligned with a centerline of a U-shaped channel formed on the truss cap.

19. The beam of claim 17 wherein the interlocking pin and slot are aligned with a centerline of the roof truss structural member.

20. A method comprising:

accessing a beam having a roof truss mounting portion and an elongate spanning portion, the elongate spanning portion having a connector and an attachment end opposite the connector, wherein the roof truss mounting portion has a bifurcated end with spaced apart yoke arms and a truss cap pivotally connected to each of the yoke arms, wherein the roof truss mounting portion has a connector, wherein the roof truss mounting portion connector is configured to be releasable connected to the elongate spanning portion connector;

arranging the beam in a manner such that the elongate spanning portion is adjacent to an outside surface of the structure;

securing the roof truss mounting portion to a first structural member of the structure;

connecting the roof truss mounting portion connector with the elongate spanning portion connector;

securing the elongate spanning portion attachment end to a second structural member of the structure vertically opposite the first structural member; and securing the spanning portion to a vertically extending structural member of the structure, the vertically extending structural member being disposed between the first and the second structural members;

wherein step of connecting the roof truss mounting portion connector and elongate spanning portion connector comprises engaging an interlocking pin on one of the roof truss portion and the elongate spanning portion with a slot on the other of the roof truss portion and the elongate spanning portion.

* * * * *